US008646245B2

(12) United States Patent
Behar et al.

(10) Patent No.: US 8,646,245 B2
(45) Date of Patent: Feb. 11, 2014

(54) METHOD AND DEVICE FOR PACKAGING A FLUID PRODUCT DISPENSER

(75) Inventors: Alain Behar, Suresnes (FR); Emmanuel Vilain, Beaubray (FR)

(73) Assignee: Aptar France SAS, Le Neubourg (FR)

( * ) Notice: Subject to any disclaimer, the term of this patent is extended or adjusted under 35 U.S.C. 154(b) by 384 days.

(21) Appl. No.: 12/598,675

(22) PCT Filed: Apr. 28, 2008

(86) PCT No.: PCT/FR2008/050762

§ 371 (c)(1),
(2), (4) Date: Apr. 23, 2010

(87) PCT Pub. No.: WO2008/155494

PCT Pub. Date: Dec. 24, 2008

(65) Prior Publication Data

US 2010/0199606 A1 Aug. 12, 2010

(30) Foreign Application Priority Data

Jun. 20, 2007 (FR) ..... 07 55876

(51) Int. Cl.

| | |
|---|---|
| ***B65B 3/04*** | (2006.01) |
| ***B65B 3/18*** | (2006.01) |
| ***B65B 31/02*** | (2006.01) |
| ***B05B 11/00*** | (2006.01) |
| ***B05B 15/00*** | (2006.01) |

(52) U.S. Cl.
USPC ..... 53/420; 53/432; 53/471; 53/133.2; 53/510; 53/281

(58) Field of Classification Search
USPC ..... 53/410, 420, 432, 433, 471, 133.1, 53/133.2, 510, 511, 281
See application file for complete search history.

(56) References Cited

U.S. PATENT DOCUMENTS

| | | | | |
|---|---|---|---|---|
| 3,718,165 | A * | 2/1973 | Grothoff | 141/20 |
| 4,278,189 | A * | 7/1981 | Kirk, Jr. | 222/321.2 |
| 4,397,132 | A * | 8/1983 | Pardes et al. | 53/471 |
| 4,437,588 | A * | 3/1984 | Shay | 222/321.2 |
| 5,102,018 | A * | 4/1992 | Desazars de Montgailhard et al. | 222/321.9 |
| 5,144,788 | A * | 9/1992 | Varlet | 53/434 |
| 5,305,810 | A | 4/1994 | Meshberg | |
| 5,425,477 | A * | 6/1995 | Montaner et al. | 222/383.1 |
| RE35,683 | E * | 12/1997 | Varlet | 53/420 |

(Continued)

FOREIGN PATENT DOCUMENTS

| | | | |
|---|---|---|---|
| EP | 408421 | A * | 1/1991 |
| EP | 0 763 469 | A1 | 3/1997 |

(Continued)

*Primary Examiner* — Stephen F Gerrity
(74) *Attorney, Agent, or Firm* — Sughrue Mion, PLLC

(57) ABSTRACT

A method for packaging a fluid product dispenser, where the said dispenser includes a reservoir (1) of constant effective volume filled with a fluid product (10), and a dispensing device (3) that includes a dip tube (2) which is intended to extract the fluid product (10) contained in the reservoir on operation of the dispensing device (3), the reservoir (1) and the dip tube (2) being made from a material or materials that are substantially or perfectly transparent, where the said dip tube initially contains air (A), and the dip tube (2) is connected to the dispensing device and has one free end extending to the bottom of the reservoir,
the method being characterized in that the air (A) is extracted from the dip tube (2) and is replaced by the fluid product.

14 Claims, 6 Drawing Sheets

(56) References Cited

U.S. PATENT DOCUMENTS

| | | | | |
|---|---|---|---|---|
| 5,769,274 | A * | 6/1998 | Behar | 222/95 |
| 5,875,932 | A | 3/1999 | Meshberg | |
| 6,691,494 | B2 * | 2/2004 | Nomoto et al. | 53/410 |
| 7,578,319 | B2 * | 8/2009 | Behar et al. | 53/471 |
| 2003/0197034 | A1 * | 10/2003 | Petit | 222/321.9 |
| 2004/0211481 | A1 * | 10/2004 | Garcia et al. | 141/20 |

FOREIGN PATENT DOCUMENTS

| | | | | |
|---|---|---|---|---|
| EP | 1 514 802 | A1 | | 3/2005 |
| FR | 2 754 788 | A1 | | 4/1998 |
| FR | 2 820 726 | A1 | | 8/2002 |
| GB | 1586447 | A | * | 3/1981 |
| WO | WO 2004105960 | A2 | * | 12/2004 |
| WO | WO 2007047168 | A2 | * | 4/2007 |
| WO | WO 2008132413 | A2 | * | 11/2008 |

* cited by examiner

METHOD AND DEVICE FOR PACKAGING A FLUID PRODUCT DISPENSER

The present invention relates to a method and a device for packaging a fluid product, aiming to improve the appearance of fluid product dispensers.

The present invention applies more particularly to the fields of perfumery, cosmetics and pharmacy. In fact, in these fields in particular, the type of pack or packaging plays a crucial role, since this is the first contact of the user with the product. The user likes to be able to see the appearance of the product through its packaging before purchasing it. As well as protecting what it is selling, the pack must sell what it is protecting.

In general, the fluid product dispensers employed in these fields include a reservoir onto which a dispensing device is fitted. Most often, the dispensing device includes a manual pump that can be operated with a finger in order to dispense measures of fluid product in a spray form or otherwise. A dip tube is connected to the input of the pump in order to extract fluid from the reservoir on operation of the pump. This dip tube has one free end that generally extends to the bottom of the reservoir. Although it is made from a transparent material, this dip tube is generally visible through even the most transparent containers and products, providing an appearance that may be less than aesthetic.

The purpose of the present invention is therefore to provide a packaging method and device that can be used to create a fluid product dispenser in which the dip tube does not show through a bottle or other transparent reservoir filled with transparent fluid.

In the prior art, many polymers are already employed in the composition of the dip tubes so as to make them transparent in most of the fluids in the field. Nevertheless, before priming, i.e. the first operation of the pump, the tube is visible in the reservoir of fluid because it contains air. In fact, during the assembly of such fluid product dispensers, a dispensing device (a pump) is generally fixed onto the neck of a reservoir filled with fluid, so that the dip tube of the dispensing device plunges into the fluid. However, the dip tube does not fill with a fluid product, since its top end is closed off by the mechanism (the valve) of the dispensing device. In addition, there exist the phenomena associated with capillary action. The dip tube therefore retains the air that it contained before the assembly of the dispenser. The dip tube, filled with air, is therefore visible when the fluid product dispenser is new, i.e. as long as the dispensing device has not yet been primed or operated for the first time. Priming allows this air to escape through the dispensing device, and fills the dip tube and the pump chamber with the fluid product from the reservoir. There is the possibility however of priming the pump before the commercialisation of the dispenser, though the liquid contained in the pump is liable to be affected or to leak. This may well put off the purchaser, who would naturally prefer to purchase an intact dispenser and product. In addition, the conservation and purity constraints are considerable for this type of product. On a display unit, the consumer is therefore never be able to see such a new fluid product dispenser with a dip tube that is invisible, even if the marketing objective of the pack at the outset was the aesthetic appearance of a transparent container.

The purpose of the present invention is therefore to provide a packaging device and method that can be used to create a fluid product dispenser in which the dip tube is invisible in a transparent reservoir containing a transparent product, even before it is primed or its first operation.

The present invention also has the objective of providing a packaging device and method that can be used to create a fluid product dispenser in which the existence of a dip tube cannot be detected and does not spoil the general attractiveness of the bottle that contains it.

A further objective of the present invention is to provide a method and a device for the packaging of fluid product dispensers that is simple and inexpensive to apply, and that can be adapted to all existing fluid product dispensers that include a dip tube.

The present invention therefore has as its subject a method for packaging a fluid product dispenser, the said dispenser including a reservoir of constant effective volume filled with a fluid product, and a dispensing device that includes a dip tube which is intended to extract the fluid product contained in the reservoir on operation of the dispensing device, the reservoir and the dip tube being made from a material or materials that are substantially or perfectly transparent, where the said dip tube initially contains air, the dip tube being connected to the dispensing device and having one free end that extends to the bottom of the reservoir, the method being characterised in that the air is extracted from the dip tube and is replaced by of the fluid product.

According to one advantageous characteristic, the dip tube filled with air is exposed to a vacuum while its free end is immersed in the fluid product.

According to a first advantageous embodiment, the method includes the following successive steps:

a. fitting the dispensing device (3) onto the reservoir in an unsealed manner, so that the dip tube is immersed in the fluid product, while still filled with air,
b. subjecting the contents of the reservoir and therefore of the dip tube to a vacuum, so that the dip tube is emptied of its air,
c. returning the contents of the reservoir to atmospheric pressure, and
d. assembling the dispensing device onto the reservoir in a sealed manner.

Advantageously, it also includes subjecting several dip tubes to a vacuum simultaneously.

According to a second embodiment, the dispenser includes a venting system with a venting passage that is suitable for connecting the interior of the reservoir with the exterior, where the method includes removal of the air from the dip tube through the venting passage of the dispenser. Advantageously, the air removal step takes place after or during the sealed assembly of the dispensing device onto the reservoir. The venting system is preferably formed by the dispensing device, which also includes a push device that can be operated axially, the venting passage of the venting system being open when the push device is operated slightly, and the step for emptying of the dip tube being effected while the push device is operated slightly in order to keep the venting passage open.

The present invention also has as its subject a packaging device to package a fluid product dispenser, where the said dispenser includes a reservoir of constant effective volume filled with a fluid product, and a dispensing device that includes a dip tube which is intended to extract the fluid product contained in the reservoir on operation of the dispensing device, where the said dip tube initially contains air, and the said packaging device includes means for expelling the air contained in the said dip tube immersed in the fluid product, characterised in that the said extraction means include a vacuum bell connected to a vacuum pump, where the said bell makes a sealed connection to the dispenser in order to create a vacuum chamber that is partially formed by the contents of the reservoir and the dip tube.

Advantageously, the dispensing device includes a venting system with a venting passage that is suitable for connecting the interior of the reservoir with the exterior, where the device also includes a push device that can be operated axially, the venting passage being open when the push device is operated slightly, and the packaging device includes pushing means to slightly operate the push device.

The principle of the invention is to extract the air from the dip tube by means of a vacuum so that it is able to fill with a fluid product without the need to operate the dispensing device. This can be achieved with the dispensing device pre-assembled onto the reservoir in an unsealed manner or indeed in the absence of the reservoir. In a variant, this can be achieved with the dispensing device assembled, by expelling the air through the venting passage, advantageously held open by pressing the push device.

Other characteristics and advantages of the present invention will appear more clearly on reading the description that follows, which is provided with reference to the appended drawings, provided by way of non-limiting examples, and in which.

Figures 4A, 4B, 4C, 4D, 4E:
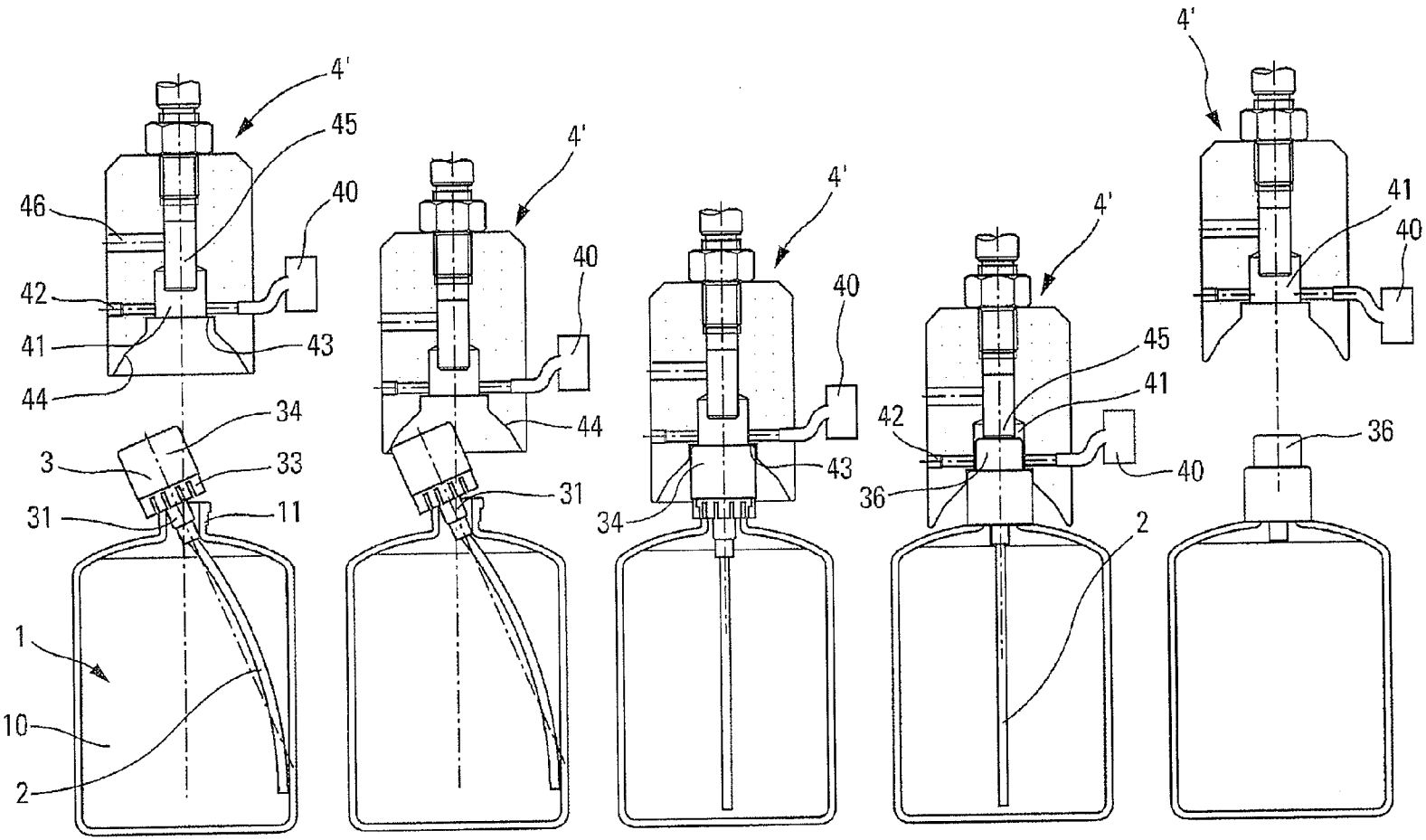
Figure 5A:
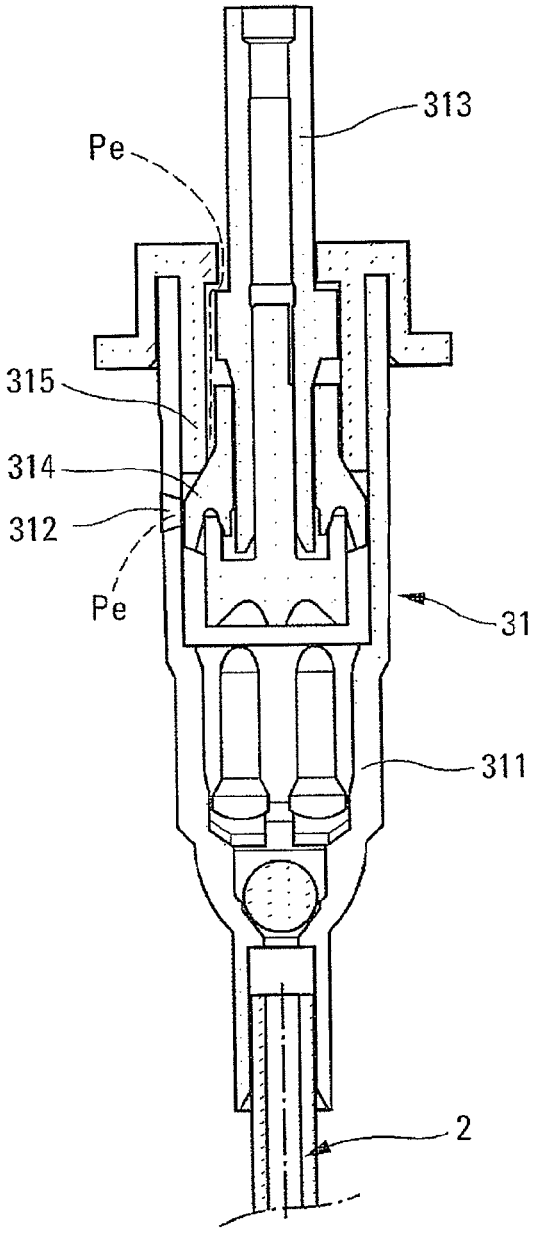
Figure 5B:
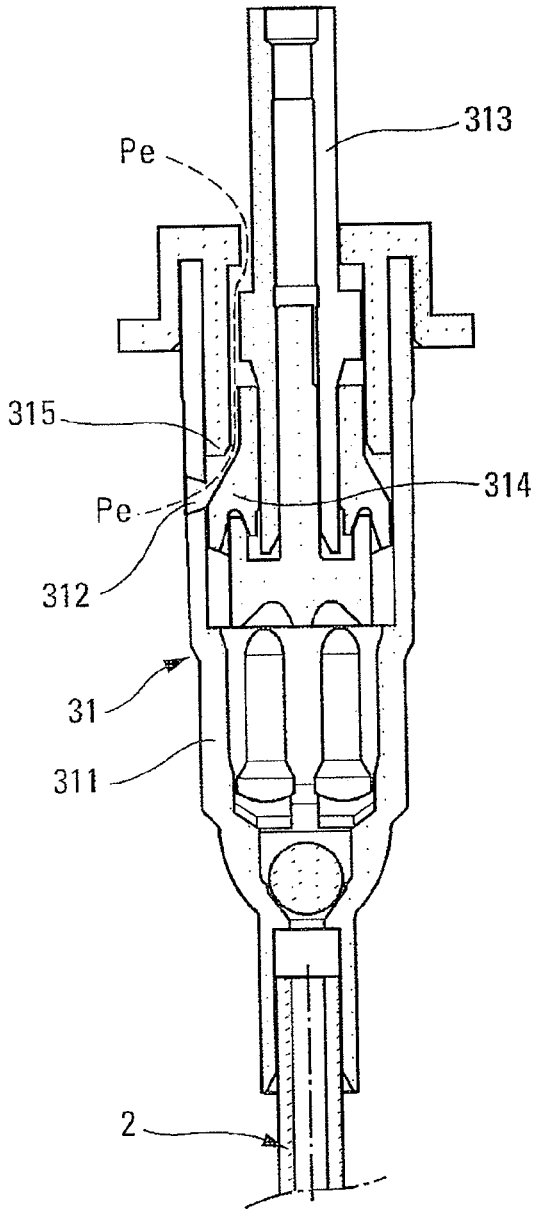

FIGS. 4*a* to 4*e* illustrate a second embodiment of the invention through five steps of packaging; and FIGS. 5*a* and 5*b* are views in vertical cross section through a pump that is usable in the second embodiment of FIGS. 4*a* to 4*e*, respectively in the rest position and in a slightly operated position in order to open the venting passage.

Figure 6:
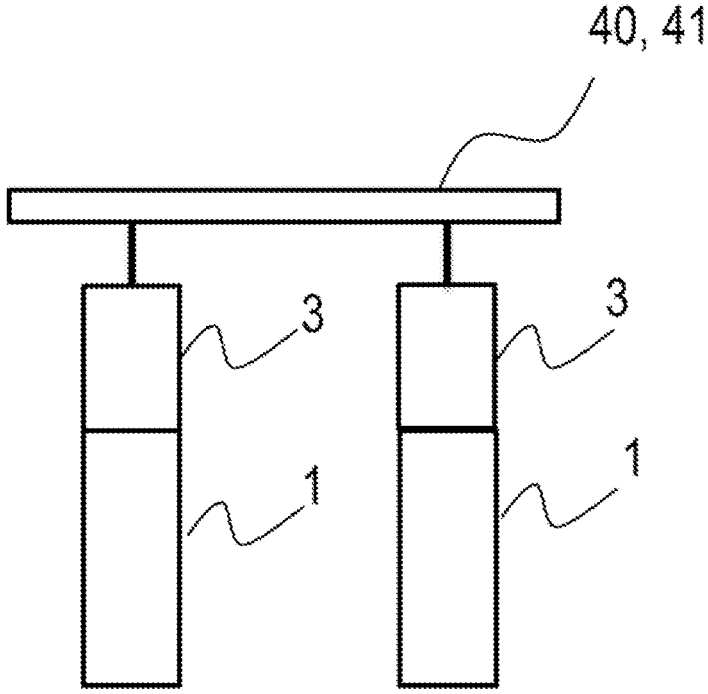

FIGS. 6 schematically illustrates subjecting several dip tubes to a vacuum simultaneously.

Referring to any of the figures, the fluid product dispenser according to the present invention includes a transparent reservoir 1 filled with a fluid product 10, and a dispensing device 3 with a dip tube 2 that is intended to extract the fluid 10 contained in the reservoir 1 on operation of the dispensing device 3.

The reservoir 1 can be of any shape. It generally has an opening in the form of a neck 11, in which the top end forms an annular flange 13. The reservoir is preferably made from a transparent material, such as glass, plastic or other materials.

The dispensing device 3 includes a dispensing device 31, such as a pump equipped with a dip tube 2 and an attachment device 32, 34 to attach the dispensing device 31 to the neck 11 of the fluid product reservoir 1, advantageously with the interposition of a sealing gasket 35.

The dip tube 2 is made from any type of material, advantageously transparent, that is familiar to those skilled in the art. The dip tube 2 is connected to the input of the dispensing device 31 and has one free end that extends into the reservoir as far as its bottom or close to the latter.

Figure 3:
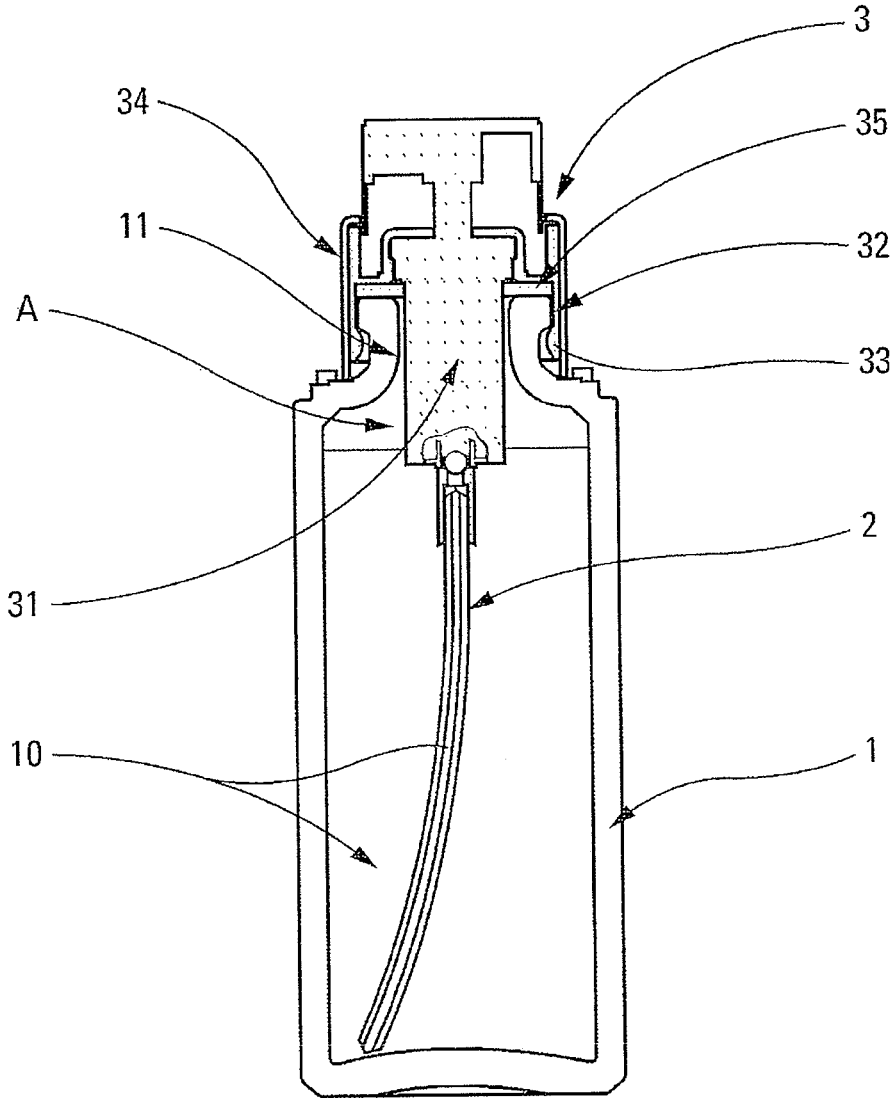
FIG. 3 is a schematic view in cross section of a fluid product dispenser after emptying and attachment of the pump.

The attachment device includes an attachment ring 32 and an external finishing band 34 that is fitted in a clamping fashion around the ring. The ring 32 includes a location housing that is suitable for firmly holding the pump 31, and attachment means 33 in order to hold the ring on the neck of the reservoir. For example, and as illustrated in the figures, the ring can include a skirt that extends downwards and that forms flexible clips 33 also extending downwards. These clips 33 are intended to click-fit below the annular flange 13 formed by the top end of the neck 11 of the reservoir 1. Final attachment of the dispensing device onto the reservoir is performed in the conventional manner by sliding downwards and radial tightening of the band 34 around the ring, as can be seen in FIG. 3, after attachment of the pump. Here, the band 34 is an external finishing band, but one can also envisage an internal band that is invisible.

This then is the conventional means of attachment of a dispensing device 3 onto the neck of a reservoir 11. These attachment means are obviously not the only possible means, and any other type of final attachment of the dispensing device onto the reservoir would be equally suitable, such as screw-fitting, crimping, bonding, welding, etc.

According to a first embodiment of the invention of the method for packaging, at least two steps are specified before the final, definitive and sealed attachment of the dispensing device 3 onto the reservoir 1.

Figure 2:
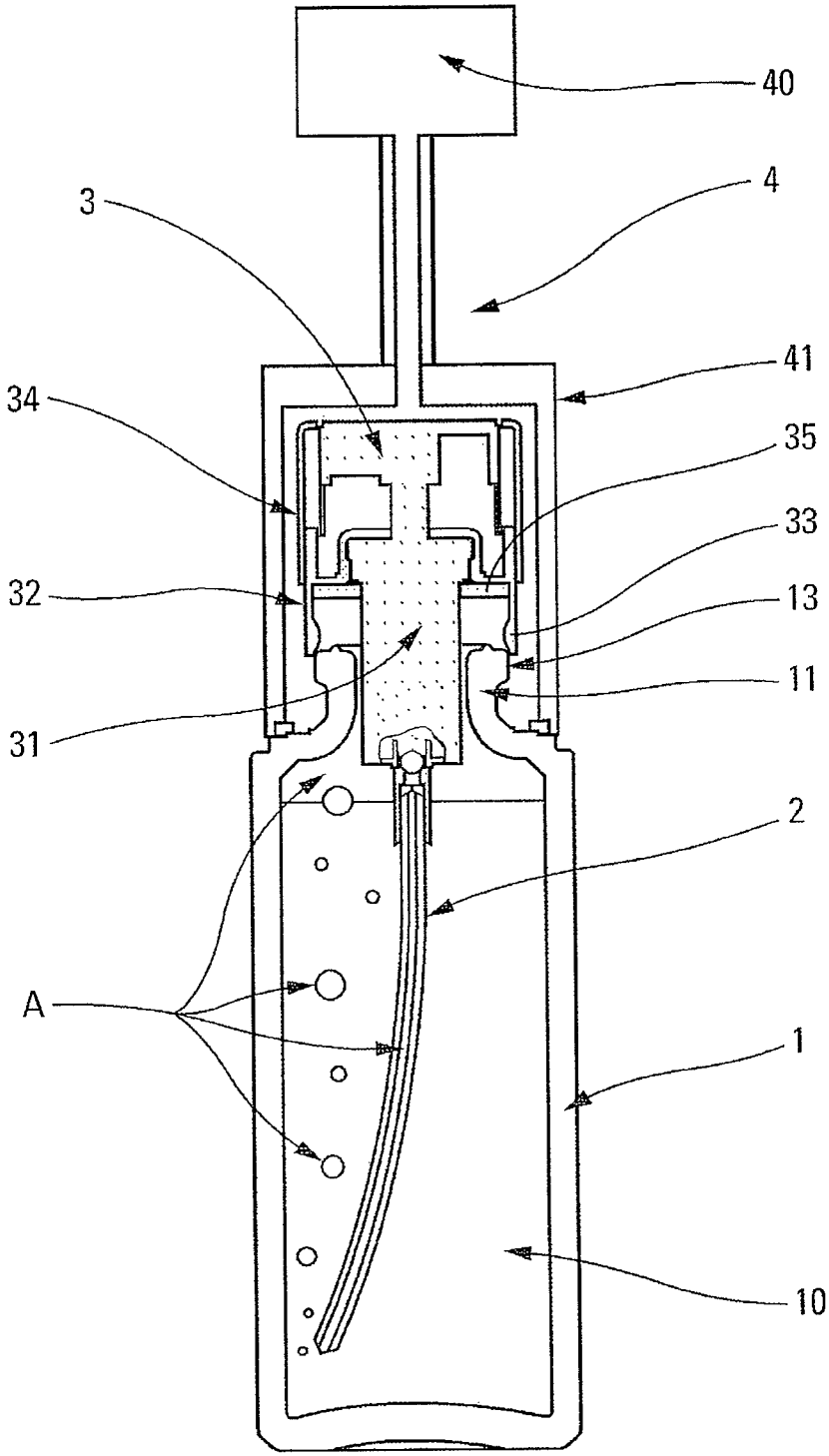
FIG. 2 is a schematic view in cross section of a fluid product dispenser during an operation for removal of air from the dip tube, according to a first embodiment of the invention.

A first step consists of fitting or engaging the dispensing device 3 in an unsealed manner onto the reservoir 1, so that the dip tube 2 is plunged or immersed over substantially all of its length in the fluid 10. As can be seen in FIG. 2, the clips 33 of the ring are positioned on the flange 13 at the end of the neck 11 of the reservoir, but not yet engaged under the flange. The space between the clips positioned on the edge of the flange allows the fluid 10 to remain at atmospheric pressure at this step. In a variant, it is also possible to engage the clips 33 around the neck without lowering the band. The air A contained in the dip tube is then trapped and unable to escape, either via its free open bottom end or via its top end which is closed off by the valve mechanism of the pump. The dip tube is then visible through the transparent reservoir, precisely due to the presence of the air A trapped in the dip tube. At the end of this step, a temporary, unsealed, attachment 301 of the dispensing device 3 onto the reservoir 1 has therefore been achieved.

A second step according to the invention consists of subjecting the contents of the reservoir 1 and therefore the dip tube 2, to a vacuum, through the use of a packaging device 4 that includes air extraction means 40, 41. These extraction means can, for example, include a vacuum bell 41 connected to a vacuum pump 40, as can be seen in FIG. 2. The vacuum bell 41 is engaged in a sealed manner, by any appropriate means, onto the reservoir 1 around the dispensing device 3. In the case of FIG. 2, the bell is engaged in a sealed manner on the outside top shoulder of the reservoir by means of an O-ring. In this case, the vacuum pump 40 therefore removes the air contained in the vacuum chamber E composed of the reservoir and the volume of the bell 41 fitted above the reservoir. Naturally, the vacuum bell could just as easily form a space of a different volume, notably greater, and could even subject to a vacuum the contents of several dispensing devices mounted in an unsealed manner onto their respective reservoirs, as schematically illustrated in FIG. 6.

During this second step, the air that is at the surface of the liquid in the reservoir is removed by the vacuum pump, passing, for example, between the clips 33 of the ring. Simultaneously, in order to balance the pressures of the liquid contained in the reservoir and of the air contained in the vacuum chamber E, the air of the dip tube immersed in the reservoir escapes via the bottom end of the dip tube, creating air bubbles that rise to the surface of the liquid 10 (see FIG. 2). The air A contained in the dip tube is progressively replaced by fluid 10 in the reservoir 1 which rises in the dip tube. At the end of this step, the dip tube filled with fluid is no longer visible through the transparent reservoir filled with transparent or translucent fluid.

According to another consecutive step of the invention, the vacuum in the enclosure E is released, and the vacuum bell is removed, so as to return the pre-assembled dispenser to atmospheric pressure.

In a final step, the dispensing device 3 is fitted onto the reservoir 1 in a sealed manner. This final configuration, represented in FIG. 3, corresponds to the conventional attachment method already described. The clips 33 of the ring 32 are engaged under the flange 13 and the band 34 is lowered to as to clamp and fix the ring on the neck 11 of the reservoir, with interposition of the sealing gasket 35. Naturally, any other type of sealed assembly can also be envisaged, such as screw-fitting, crimping, etc. At the end of this step, the new dispenser packaged according to the method or the device of the invention can therefore make one believe that there is no dip tube in the transparent container of the dispenser.

In a variant, it is also possible to attach the dispensing device definitively to the reservoir in a sealed manner while the vacuum is maintained in the vacuum chamber.

The invention has been described with reference to a first particular embodiment of the latter, but it is intended that diverse modifications can be made to this. In particular, the dip tube 2 could be created as a single piece with the attachment device 30, 33 that fixes the pump to the reservoir. The step a then corresponds to the pre-assembly of the attachment device, including the dip tube, onto the reservoir in an unsealed manner. The dispensing device and the attachment device are not assembled in a sealed manner onto the neck of the reservoir until step d. One can also envisage filling the dip tube by removal of the air under vacuum before it is fitted onto the reservoir, the fluid product being held in the dip tube by capillary action. It is thus possible to simultaneously package a large number of dip tubes in a single vacuum chamber.

We now refer to FIGS. 4*a* to 4*e* and 5*a*, 5*b*, which describe a second embodiment of the present invention. In the first embodiment described with reference to FIGS. 1 to 3, removal of the air present in the dip tube takes place while the dispensing device 3 has not yet been assembled definitively and sealed on the neck 11 of the reservoir. In this second embodiment, removal of the dip tube is effected with the dispensing device 3 assembled definitively and sealed on the neck of the reservoir. Removal of the dip tube can thus be effected just after or during the sealed and definitive assembly of the dispensing device on the neck of the reservoir.

Figure 1:
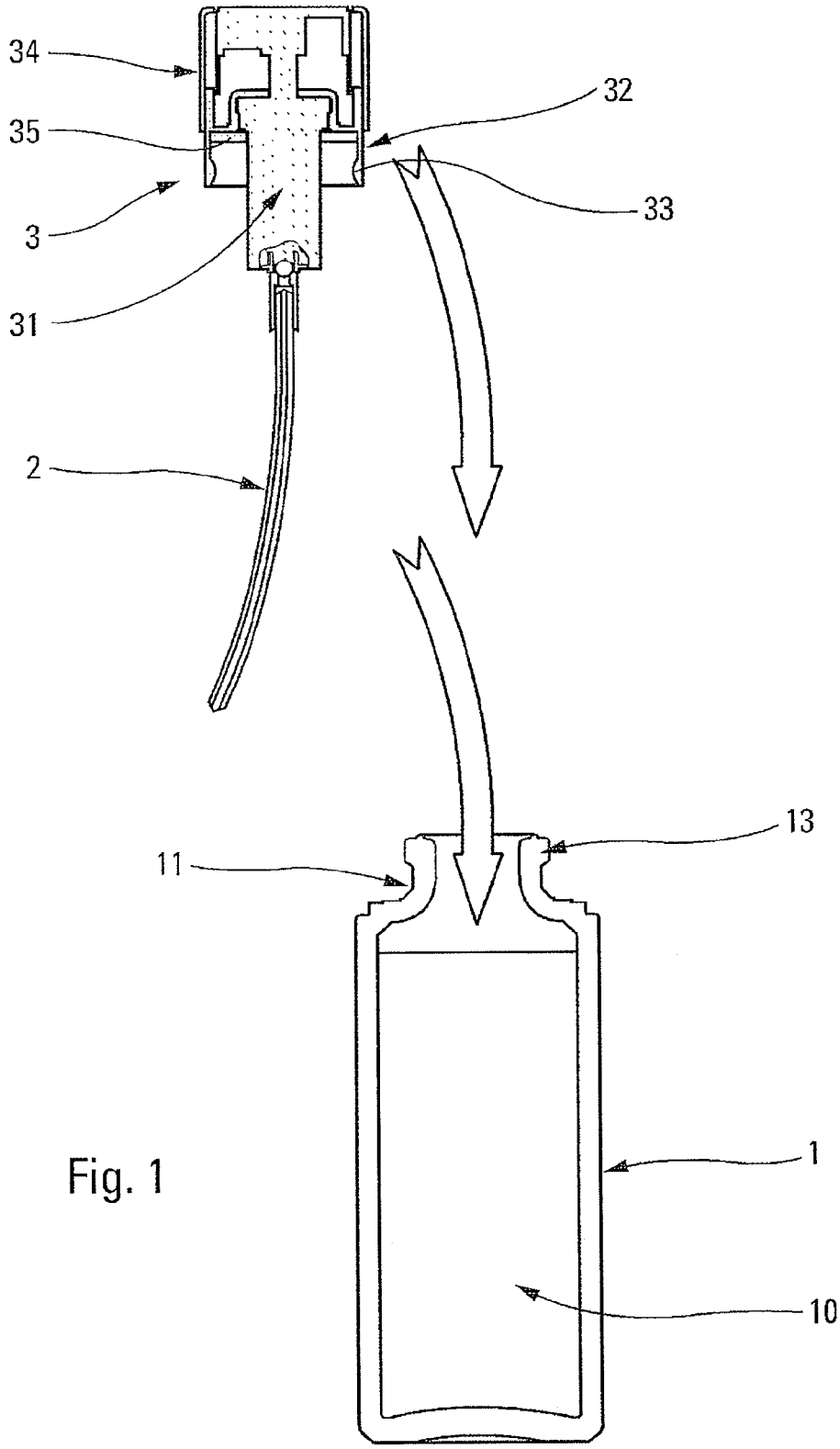
FIG. 1 is a schematic view in cross section of a fluid product dispenser according to the invention before fitting the pump.

This second embodiment also uses a packaging device 4' that has several characteristics in common with the packaging device 4 of the first embodiment of FIGS. 1 to 3. Amongst other things, the packaging device 4' includes a vacuum bell 41 connected to a vacuum pump 40 which is used to extract the air from an enclosure E. The bell 41 is intended to engage in a sealed manner with the dispenser, and more particularly with the external finishing band 34 of the dispensing device 31. To this end, the bell 41 has a contact lip 43 that makes sealed contact with the annular top edge of the band 34, as can be seen by referring to FIGS. 4*c* and 4*d*. The bell 41 can also include an air-intake passage 42 that connects the interior of the enclosure E to the atmosphere. This passage 42 is preferably calibrated, and can optionally be fitted with a valve (not shown). Such an intake passage 42 can also be included in the bell of the embodiment of FIGS. 1 to 3. In addition, the packaging device 4' has an axial alignment cone 44 that is used to bring the dispensing device 3 into a perfectly axial position for its sealed assembly onto the neck of the reservoir. The alignment cone 44 is just located below and in the extension of the contact lip 43. In its upper part, the bell 41 is equipped with a rod 45 whose bottom free end projects inside the bell 41. The axial positioning of this rod can be adjusted by means of a control 46. This rod 45 is used as a push device to slightly operate the push device 36 of the dispensing device 3, as will be seen below. Axial adjustment of the rod 45 is used to adapt the packaging device 4' to the different configurations of push device 36, which can be of varying height.

In order to be able to use the packaging device 4' and implement the method according to the second embodiment of the invention, it is necessary to use a particular type of dispensing device 31, namely a dispensing device that is equipped with a venting system, with a venting passage that is suitable for connecting the interior of the reservoir to the exterior, through the dispensing device. FIGS. 5*a* and 5*b* show a dispensing device in the form of a pump. In FIG. 5*a*, the pump is in its rest position. The push device has not been shown. This is a quite conventional pump that can frequently be found in the perfumery, cosmetics or indeed the pharmacy fields. This pump includes a body 311 to which the dip tube 2 is connected. The body 311 is formed with a vent hole 312 that passes through the thickness of the body wall. However, the hole 312 is closed off by a piston 314 assembled on an operating rod 313 that projects axially out of the body 311. In order to keep the piston and the operating rod inside the body 311, provision is made for a ferrule 315 which thus forms the top dead centre of rest of the piston and of the operating rod. A venting passage Pe is formed between the ferrule 315 and the operating rod 313, but this passage is closed off at the piston 314 which makes sealed contact with the bottom inside edge of the ferrule 315. This can be seen clearly in FIG. 5*a*. In addition, or in a variant, the piston 314 closes off the vent hole 312. Thus, the passage connecting the vent hole 312 to the exterior is plugged at the ferrule 315 and/or at the hole 312 by the piston 314.

On the other hand, by slightly pressing the operating rod 313 in an axial manner, normally accomplished by pressing the push device, the piston 314 comes away from the ferrule 315 and exposes the vent hole 312. Thus, a continuous venting passage Pe is created between the vent hole 312 and the exterior. This can be seen clearly in FIG. 5*b*, in which the venting passage is represented by a broken line. Thus, the body 311, the operating rod 313, the piston 314 and the ferrule 315 together form a venting system that is used to create or to plug a venting passage Pe connecting the interior of the reservoir to the exterior. This is used to equalise the pressures between the interior of the reservoir and the exterior of the reservoir, in order not to create low pressure inside the reservoir. Thus, the venting passage Pe is formed while the push device is operated very slightly. It is therefore not necessary to operate the pump fully, and to dispense a measure of fluid product in order to open the venting passage. One can thus say that the opening of the venting passage is effected before full operation of the pump.

The second embodiment of the invention makes use of the venting system of the dispensing device 31 to remove the air present inside the reservoir and inside the dip tube, so as to fill the dip tube with fluid product.

We will now refer to FIGS. 4*a* to 4*e* to describe one complete cycle for the fitting and removal of a fluid product dispenser fitted with a dispensing device of the type illustrated in FIGS. 5*a* and 5*b*. FIG. 4*a* represents a dispenser that includes a reservoir 1 with a neck 11 in which a dispensing device 3 has been placed. The dispensing device 3 is not positioned axially, since for the moment it is not fixed onto the neck 11. The packaging device 4' is located axially above the reservoir 1. Referring to FIG. 4*b*, the packaging device 4' has been lowered so that the dispensing device 3 is in contact with the alignment cone 44 allowing the dispensing device 3 to be straightened axially. More precisely, the edge of the top end of the band 34 slips inside the cone 44 until is makes contact with the contact lip 43. This is represented in FIG. 4*c*. The contact between the band and the contact lip does not need to be sealed, and indeed a leak at this point can even turn out to be advantageous. The clips of the ring are already in place around the neck, but the finishing band 34 has not yet been lowered around the clips. By continuing to lower the packaging device 4', the band 34 is lowered around the clips, as can be seen in FIG. 4*d*. The bottom end of the band 34 is now able to press onto the reservoir. By maintaining the pressure on the band (34), a chamber E is formed in which the push device 36 of the dispensing device 31 is located. However, the push device 36 is operated slightly or pressed in by the rod 45, with the consequence of opening the venting system and creating the venting passage Pe (not shown). This is represented in FIG. 4*d*. The interior of the bell 41 then communicates with the interior of the reservoir and therefore with the dip tube 2 through the venting passage. By operating the vacuum pump 40, a vacuum is created not only inside the enclosure E but also inside the reservoir, and especially inside the dip tube 2. As in the first embodiment, the effect of this vacuum is to extract the air from the dip tube, forming air bubbles that move to the top of the fluid product in the container, as can be seen in FIG. 4*d*. The dip tube is then empty of both air and fluid product. The air-intake passage 42 advantageously remains open during the operation of the pump 40. In fact, it is not necessary to have a very high vacuum in order to remove the air from the dip tube. The passage 42 is used to allow the outside air to enter into the reservoir. Its section is calibrated according to the extraction power of the vacuum pump 40 and any leakage between the contact lip 43 and the band 34. The intake of air into the enclosure unsticks the lip 43 form the band without the need to stop the vacuum pump 40. This considerably reduces the length of the fitting cycle. In addition, there is no valve to be controlled and/or sequenced. As soon as the dip tube is emptied of its air, which occurs with less than 1 second, it is then necessary only to return the enclosure E to atmospheric pressure in order to fill the dip tube with fluid product. This is effected very simply by unsticking the lip 43 from the band, advantageously without interrupting or stopping the extraction process. The packaging device 4' can then be refitted in order to free the dispenser with its dip tube filled with a fluid product, and advantageously transparent. This can be seen in FIG. 4*e*.

It is also possible to use controlled valves at the vacuum pump and at the air-intake passage in order to sequence the phases of vacuum and return to atmospheric pressure. Nevertheless, it turns out that a simple calibrated intake of air is sufficient to create a satisfactory vacuum in the enclosure, and to break open this enclosure without the need to cut off the intake of the vacuum pump. The cycle for the fitting of a dispenser is only very slightly extended by the operation of emptying and refilling the dip tube.

In both of the embodiments, the dip tube filled with air is subjected to a vacuum while its free end is immersed in the fluid product, the extracted air being replaced rapidly by the fluid product on return to atmospheric pressure. Removal of the air from the dip tube can be effected before or after the sealed and definitive assembly of the dispensing device onto the reservoir.

The invention claimed is:

1. A method for packaging a fluid product dispenser, where the dispenser comprises a reservoir of constant effective volume filled with a fluid product, and a dispensing device that comprises a dip tube configured to extract the fluid product contained in the reservoir on operation of the dispensing device, the reservoir and the dip tube being made from a material or materials that are substantially or perfectly transparent, where the dip tube is initially connected to the dispensing device and initially contains air, and the dip tube has one free end extending to a bottom of the reservoir, wherein the method comprises extracting the air from the dip tube and replacing the air by the fluid product when the dip tube is connected to the dispensing device; the method of extracting the air and replacing the air comprises the following successive steps:

a. fitting the dispensing device onto the reservoir in an unsealed manner, so that the dip tube is immersed in the fluid product, while still filled with air, b. subjecting an interior of the reservoir and the dip tube to a vacuum so that the dip tube is emptied of the air, c. returning the interior of the reservoir to atmospheric pressure, and d. assembling the dispensing device onto the reservoir in a sealed manner.

2. The method according to claim 1, wherein the dip tube filled with the air is subjected to the vacuum while the free end of the dip tube is immersed in the fluid product.

3. The method according to claim 1, further comprising subjecting several dip tubes to a vacuum simultaneously.

4. The method according to claim 1, wherein a calibrated intake of air through a separate passage, takes place during extraction of the air.

5. A method for packaging a fluid product dispenser, where the dispenser comprises a reservoir of constant effective volume filled with a fluid product, and a dispensing device that comprises a dip tube configured to extract the fluid product contained in the reservoir on operation of the dispensing device, the reservoir and the dip tube being made from a material or materials that are substantially or perfectly transparent, where the dip tube is initially connected to the dispensing device and initially contains air, and the dip tube has one free end extending to a bottom of the reservoir, wherein the method comprises extracting the air from the dip tube and replacing the air by the fluid product when the dip tube is connected to the dispensing device; and wherein the dispenser comprises a venting system with a venting passage that is suitable for connecting an interior of the reservoir with the exterior, and where the method further comprises removal of the air from the free end of the dip tube and through the venting passage of the dispenser.

6. The method according to claim 5, wherein the air removal step takes place after or during sealed assembly of the dispensing device onto the reservoir.

7. The method according to claim 5, wherein the venting system is formed by the dispensing device, which also comprises a push device configured to be operated axially, the venting passage of the venting system being open when the push device is operated slightly, and emptying the dip tube of air being effected while the push device is operated slightly, in order to keep the venting passage open.

8. A packaging device used to package a fluid product dispenser, the dispenser comprising a reservoir of constant effective volume filled with a fluid product, and a dispensing device with a dip tube configured to extract the fluid product contained in the reservoir on operation of the dispensing device, where the dip tube initially contains air, the packaging device comprising extraction mechanism to extract the air contained in the dip tube immersed in the fluid product, the extraction mechanism comprises a vacuum bell connected to a vacuum pump, the vacuum bell engaging in a sealed manner with the dispenser in order to create a vacuum chamber that is partially formed by an interior of the reservoir and the dip tube.

9. The device according to claim 8, wherein the dispensing device comprises a venting system with a venting passage that is suitable for connecting the interior of the reservoir with the exterior, where the device also comprises a push device being operated axially, the venting passage being open when the push device is operated slightly, and where the packaging device comprises pushing means to slightly operate the push device.

10. The device according to claim 8, wherein the extraction mechanism also comprises an air-intake passage allowing air to enter the enclosure, even during the extraction process.

11. A packaging device used to package a fluid product dispenser, comprising:

a reservoir filled with a fluid product;

a dispensing device with a dip tube configured to extract the fluid product from the reservoir on operation of the dispensing device, the dip tube initially containing air;

extraction means for extracting the air in the dip tube while immersed in the fluid product in order to create a vacuum chamber that is partially formed by an interior of the reservoir and the dip tube.

12. A method for packaging a fluid product, comprising:

providing a reservoir filled with a fluid product;

providing a dispensing device that comprises a dip tube configured to extract the fluid product from the reservoir on operation of the dispensing device, the dip tube initially connected to the dispensing device and initially containing air, a free end of the dip tube extending within the reservoir;

fitting the dispensing device onto the reservoir in an unsealed manner, so that the dip tube is immersed in the fluid product, while still filled with air;

subjecting an interior of the reservoir and the dip tube to a vacuum so that the dip tube is emptied of the air by causing the air to escape from the free end of the dip tube;

returning the interior of the reservoir to atmospheric pressure; and assembling the dispensing device onto the reservoir in a sealed manner.

13. The method according to claim 12, wherein the reservoir and the dip tube are made from a material or materials that are substantially or perfectly transparent.

14. A method for packaging a fluid product dispenser, comprising:

providing a reservoir filled with a fluid product;

providing a dispensing device that comprises a dip tube configured to extract the fluid product from the reservoir on operation of the dispensing device, the dip tube initially connected to the dispensing device and initially containing air, a free end of the dip tube extending within the reservoir;

extracting the air from the dip tube and replacing the air by the fluid product when the dip tube is connected to the dispensing device; and removing the air from the dip tube via the free end of the dip tube and through a venting passage in the dispenser device that connects an interior of the reservoir with the exterior.

* * * * *